United States Patent [19]

Spevak

[11] 4,170,392

[45] Oct. 9, 1979

[54] ARTICLE SUPPORTING ARRANGEMENT

[75] Inventor: Stephen T. Spevak, Takoma Park, Md.

[73] Assignee: Potomac Applied Mechanics, Inc., Bethesda, Md.

[21] Appl. No.: 907,321

[22] Filed: May 18, 1978

[51] Int. Cl.[2] ..... A47B 97/00; A47B 81/00

[52] U.S. Cl. ..... 312/283; 206/373; 211/169; 312/DIG. 33; 312/305

[58] Field of Search ..... 312/DIG. 33, 138 A, 312/283, 285, 197, 202, 305, 244; 206/272, 273; 211/169

[56] References Cited

U.S. PATENT DOCUMENTS

| | | | |
|---|---|---|---|
| 68,434 | 9/1867 | Gould | 16/156 |
| 220,965 | 10/1879 | Decombe | 16/162 |
| 620,013 | 2/1899 | Barnes | 312/283 |
| 929,074 | 7/1909 | Brown et al. | 217/9 |
| 1,180,598 | 4/1916 | Mills | 16/165 |
| 1,427,800 | 9/1922 | French | 16/163 |
| 3,092,428 | 6/1963 | Kerschner | 206/373 |
| 3,379,484 | 4/1968 | Kling | 211/169 |

FOREIGN PATENT DOCUMENTS

| | | | |
|---|---|---|---|
| 708608 | 7/1931 | France | 312/283 |

*Primary Examiner*—Mervin Stein
*Assistant Examiner*—A. Grosz
*Attorney, Agent, or Firm*—Cushman, Darby & Cushman

[57] ABSTRACT

The invention relates to an article supporting assembly that is useful as a toolbox, for shelving, for article display purposes, and a wide variety of other purposes. The basic assembly includes a center plate, at least two spanners, each having first and second opposite edges, at least two cover plates, and article supporting structures formed on the center plate and the cover plates. Each of the spanners is hinged to the center plate generally along the first spanner edges, the cover plates are hinged together, and each cover plate is hinged to a spanner generally along the second edge of the spanner, so that the cover plates are pivotal from a first position generally parallel to the center plate (spaced the width of the spanner) to a second position generally perpendicular to the center plate. A casing preferably surrounds the center plate, with a handle formed on the casing. Two sets of spanners and cover plates may be provided, one on each side of the center plate, and the center plate may be mounted on the casing for rotational movement.

19 Claims, 6 Drawing Figures

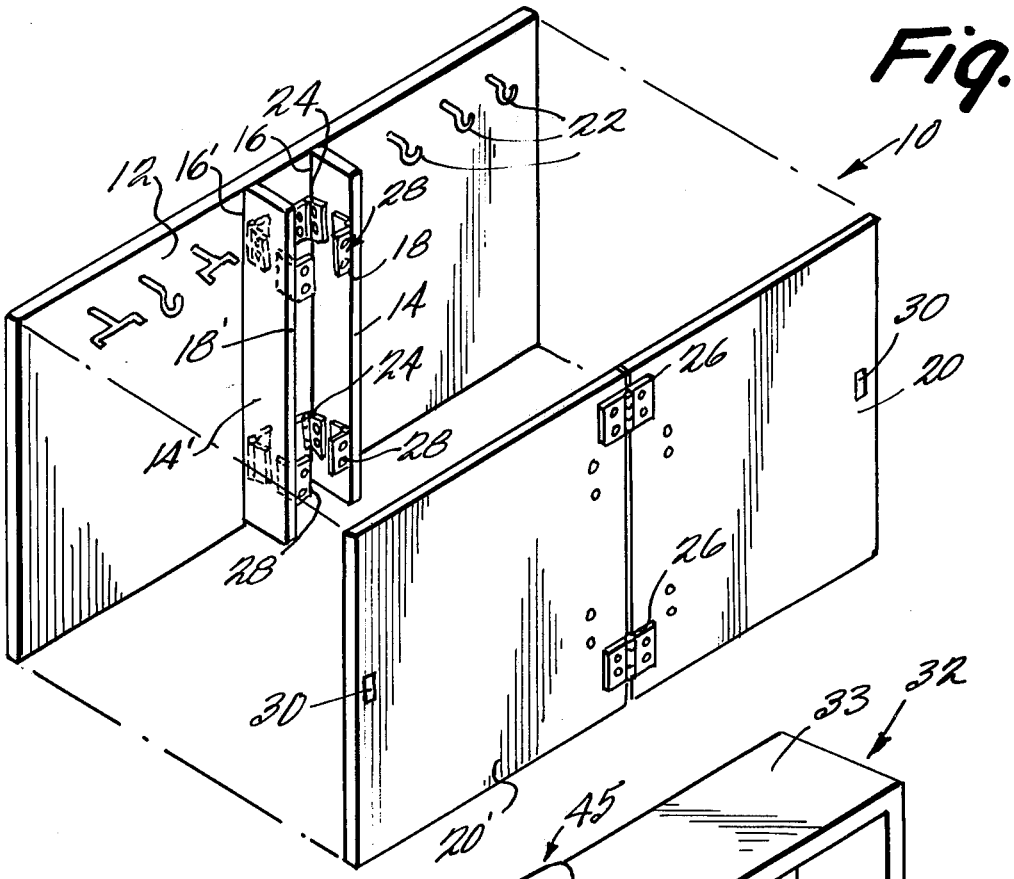
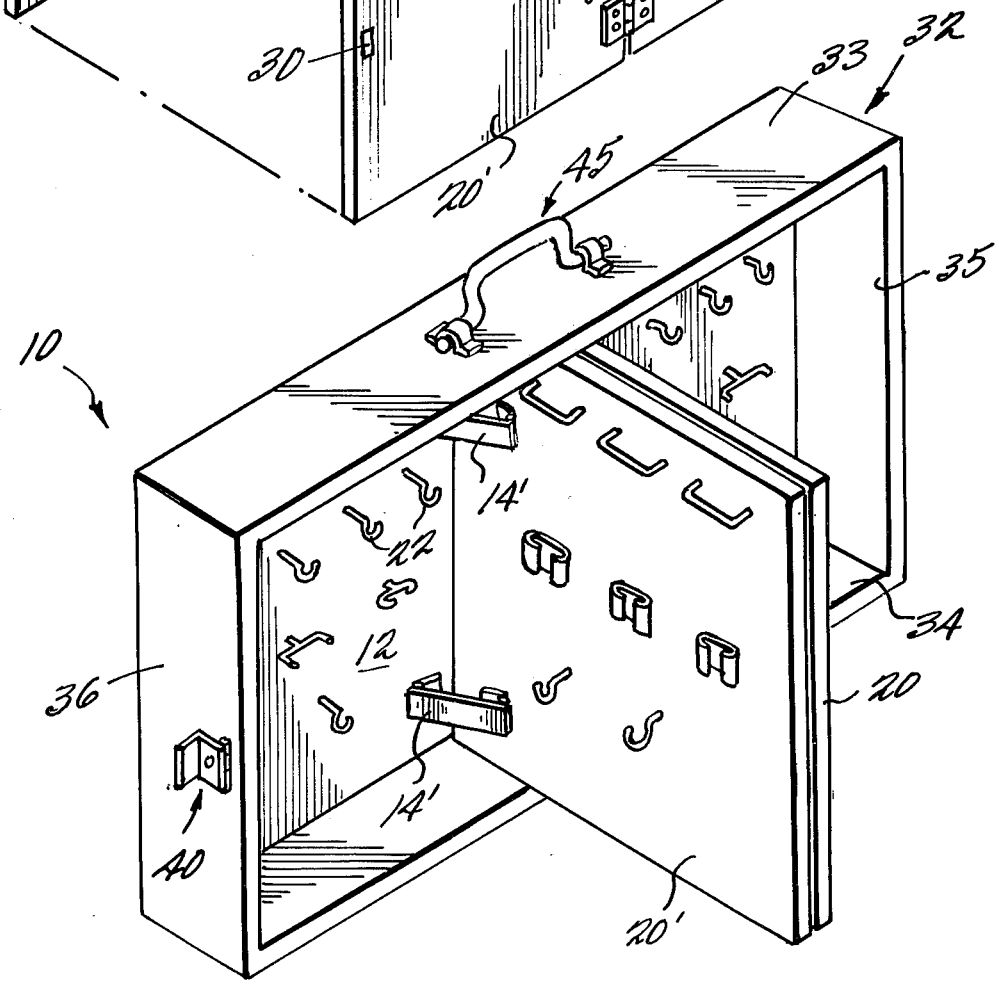
Fig. 5

Fig. 2
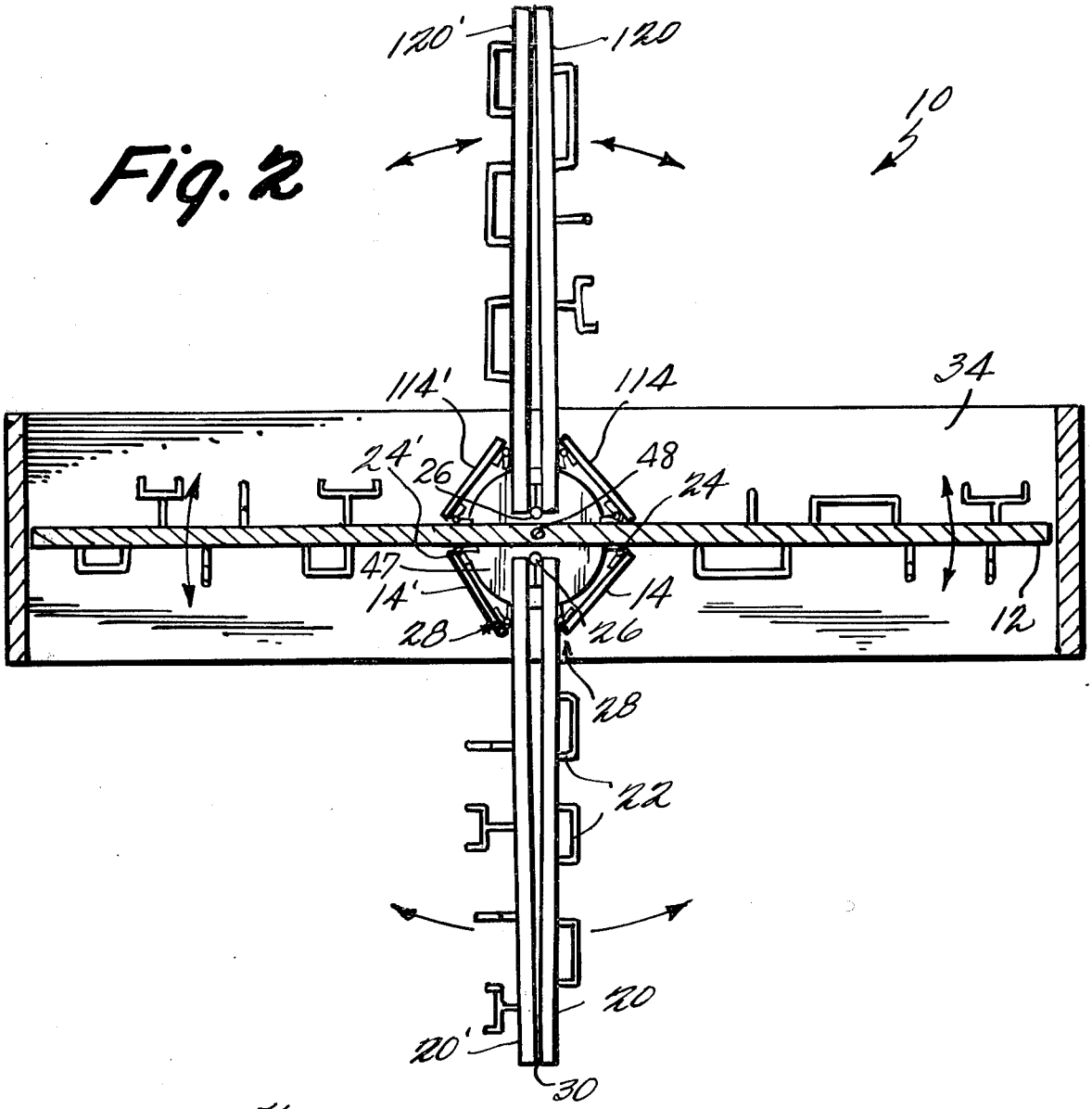
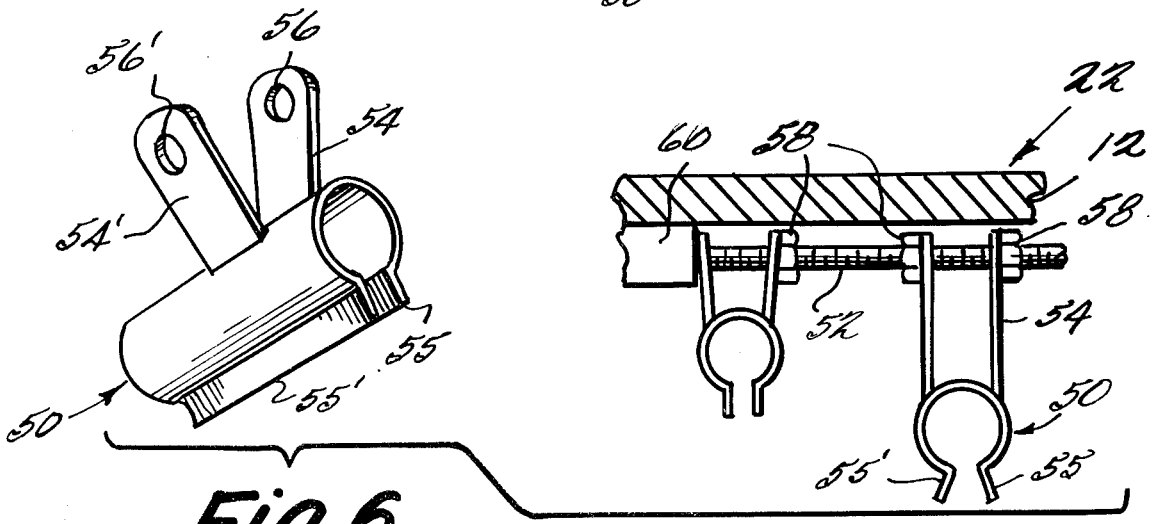
Fig. 6

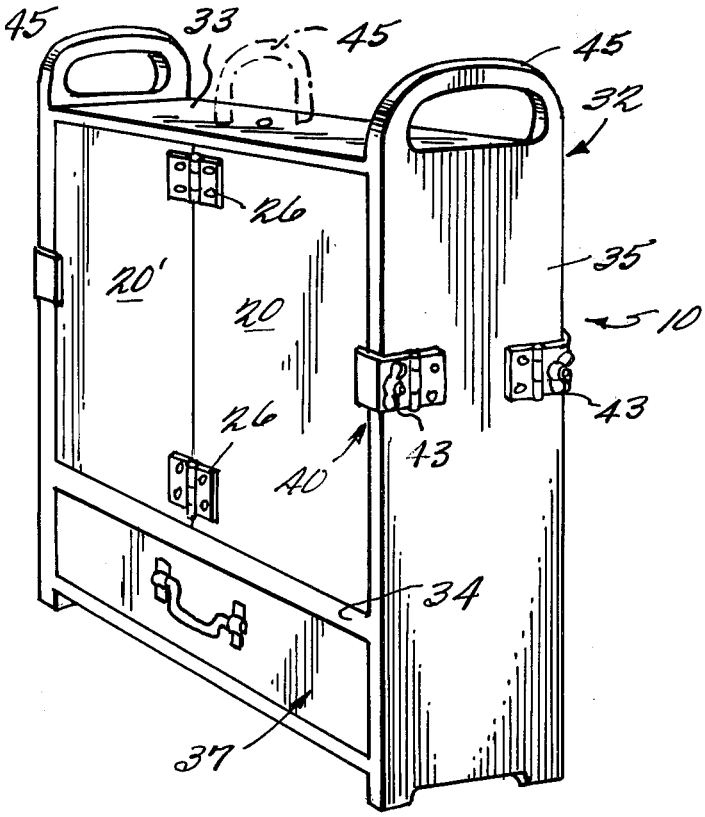
Fig. 3
Fig. 4
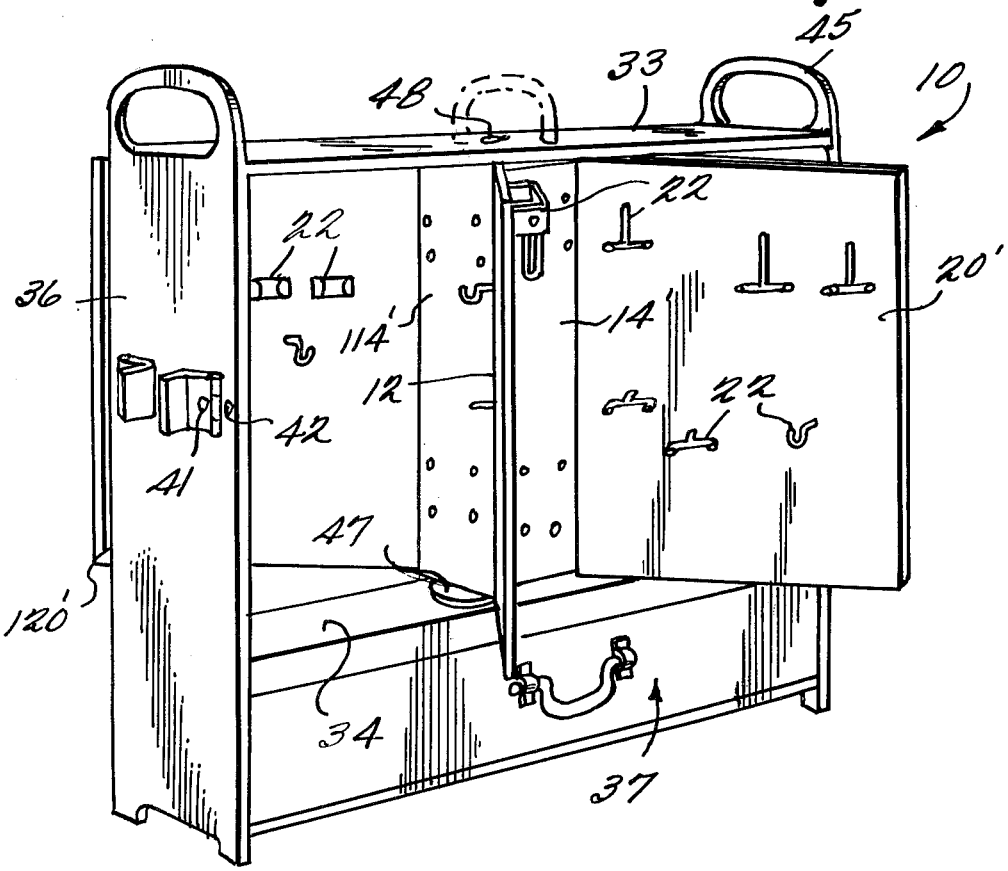

ARTICLE SUPPORTING ARRANGEMENT

BACKGROUND AND SUMMARY OF THE INVENTION

There are a wide variety of commercially available toolboxes, display kits, sample cases, and the like for the convenient mounting of articles to be displayed or utilized. Oftentimes in such prior commercially available constructions, however, inefficient use is made of the case space, and it is difficult to readily discern and/or remove all of the individual articles contained by the case.

According to the present invention, an article supporting assembly is provided that makes maximum use of the available space and is adapted to support all of the articles associated therewith in a manner so that they may be readily seen and/or utilized. The assembly according to the present invention may have a wide variety of uses, such as a toolbox, display kit, sample case, cabinet arrangement, etcetera.

According to the present invention, an article supporting assembly is provided which comprises a center plate; at least two spanners, each having first and second opposite edges, each of the first and second edges of each spanner parallel to but spaced from the other; at least two cover plates; article supporting means formed on at least one of the center plate and the cover plates; and means for hinging each of the spanners to the center plate generally along the spanner first edges, and means for hinging the cover plates together, and means for hinging a cover plate to each of the spanners generally along the second edge of each of the spanners, so that the cover plates are pivotal from a first position generally parallel to the center plate (but spaced therefrom a distance corresponding to at least the width of the spanner) to a second position generally perpendicular to the center plate. A casing is preferably provided surrounding the center plate, with a handle on the casing, for ease of transport, as well as structures for locking the cover plates in their first position with respect to the center plate, and attaching the cover plates to each other in the first position of each. Also, the center plate may be pivotally mounted to the casing, and a second set of spanners and cover plates be provided on the opposite face of the center plate from the first set of cover plates and spanners.

It is the primary object of the present invention to provide an article supporting assembly that makes maximum use of the space defined thereby, and supports each article in a manner so that it may be readily seen and/or removed. This and other objects of the invention will become clear from an inspection of the detailed description of the invention, and from the appended claims.

BRIEF DESCRIPTION OF THE DRAWINGS

FIG. 1 is a perspective exploded view of an exemplary basic assembly according to the present invention;

FIG. 2 is a top plan view of another exemplary assembly according to the invention;

FIG. 3 is a perspective view of an exemplary assembly according to the invention suitable for use as a toolbox or the like, shown in closed condition;

FIG. 4 is a perspective view of the assembly of FIG. 3 in opened-up position;

FIG. 5 is a perspective view of another exemplary assembly according to the invention; and FIG. 6 is a top detail view, showing a spring clip, in perspective, of exemplary article supporting means utilizable according to the invention.

DETAILED DESCRIPTION OF THE DRAWINGS

An exemplary article supporting assembly according to the invention is shown generally at 10 in the drawings. All embodiments shown in the drawings have in common the following basic features: a center plate 12, at least two spanners 14, 14', each having first and second opposite edges 16, 18 and 16', 18', respectively, each of the first and second edges of each spanner parallel to but spaced from the other; at least two cover plates 20, 20'; article supporting means 22 formed on at least one of the center plate 12 and the cover plates 20, 20'; means 24 for hinging each of the spanners 14, 14' to the center plate generally along the spanner first edges 16, 16', and means 26 for hinging the cover plates 20, 20' together, and means 28 for hinging a said cover plate 20, 20' to each of the spanners 14, 14' generally along the second edge 18, 18' of the spanner, so that the cover plates 20, 20' are pivotal from a first position (see FIG. 1) in which they are generally parallel to the center plates 12, but spaced therefrom at least the width of the spanners 14, 14', to a second position—see FIGS. 2 and 5—wherein they are generally perpendicular to the center plate 12. In the second position (FIGS. 2 and 5), the plates 20, 20' preferably are disposed in face-to-face relationship, and means are provided for attaching the plates 20, 20' in this position, such as permanent magnets 30.

While the terms "plate" and "spanner" are used to describe the components 12, 14, 20, etcetera, such terms should be interpreted broadly, and are not restricted to only thin, completely flat, continuous members, such as shown in FIG. 1. For instance, the members may be segmented (see spanners in FIG. 5), have a curvature, and have different shapes than illustrated in the drawings, the representations in the drawings being only exemplary.

The hinge means 24, 26 and 28 may comprise any suitable structures for allowing the relative pivotal movement desired, and preferably comprise ordinary cabinet hinges or the like. The components may be made of any suitable material, including wood, plastic, and metal, and the article supporting components 22 may comprise any conventional components suitable for supporting desired articles, including, but not limited to, brackets, hooks, shelves, elastic bands, magnets, spring clips, contour projections, and pockets. Supporting means 22' also may be provided on the spanners 14, 14' if desired and, in fact, separate plates may extend outwardly from middle portions of the spanners 14, 14' between the plates 12 and 20, 20', and such separate plates may also have article supporting means associated therewith. The plates 12, 20, 20' may be electromagnetized.

If desired, a second set of cover plates and spanners may be provided, such as shown in FIGS. 2 and 4, and especially at 114, 114', 120, 120' in FIG. 2.

A casing means 32 is preferably provided for covering the space between the cover plates 20, 20' and the center plate 12 when the cover plates are in the first position, such casing means being able to take a wide variety of forms, two of which are shown in FIGS. 3 and 5. For instance, the casing means may comprise a housing that is generally quadrate in plan, and includes top 33, bottom 34, and two side portions 35, 36, with two open end portions corresponding to the cover plates 20, 20' and the center plate 12. The two side portions 35, 36 will preferably have a width at least as large as the width of the spanners 14, 14', or in the situation where two sets of spanners and cover plates are provided, the width will be at least as large as the sum of the spanner widths. (See FIGS. 3 and 4, for example). In the embodiment shown in FIG. 5, the casing means 32 is integrally connected to the center plate 12, the center plate 12 forming one end of the casing means 32. In all embodiments, the casing portions 33 through 36 need not be flat, but may be curved, and may be of any desired shape.

Where the assembly 10 according to the invention is to be used for a tool case, display kit, sample case, or the like, a handle 45 is preferably associated therewith to facilitate lifting and movement of the assembly. Other structures may also be associated with the casing 32, such as a drawer 37 (see FIGS. 3 and 4) mounted below the bottom portion 34, or above the top portion 33. Also, to hold the cover plates 20, 20' in a position with respect to the casing means 32 so that they will not move, releasable holding means may be provided. Such holding means, which are illustrated in exemplary form at 40 in the drawing (see FIGS. 3–5 in particular) hold the cover plates to the casing means so that the cover plates are immobile with respect to the casing means and the center plate when the releasable holding means 40 are activated. The releasable holding means 40 may comprise a conventional right angle portion hinged at one edge thereof to a side portion 35, 36 (see FIG. 4) with an opening 41 formed in one face thereof, for cooperation with another (i.e., threaded) opening 42 formed in the side portion 36, 36' with which it cooperates. A conventional wing nut 43 (see FIG. 3) or the like is threaded through the openings 41, 42 to immobilize the cover plates, as shown in FIG. 3.

Additionally, according to the present invention, it may be desirable to mount the center plate 12 so that it is rotatable with respect to a support with which it is associated (i.e., bottom portion 34 of casing 32), such an arrangement being especially useful when the second set of spanners and cover plates 114, 114', 120, 120' are utilized. Exemplary means for so rotatably mounting the center plate 12 may comprise a lazy susan—illustrated schematically at 47 in FIG. 2—mounted to the support 34 for the center plate 12, and to the center plate 12. For stability, especially where the center plate 12 has significant height, a pivot pin 48 (see FIGS. 2 and 4) may be provided extending the entire height of the center plate 12, and inserted in the top portion 33 of casing means 32, the top portion 33 forming a bushing for the rod 48.

One exemplary article or receiving means 22 that may be utilized according to the present invention is shown in FIG. 6. Such means utilizes conventional spring clips 50 and a threaded rod 52. Each spring clip 50 has two arms 54, 54' and two pincher faces 55, 55', means defining an opening 56, 56' in each of the arms 54, 54', respectively. at a portion thereof remote from the pincher faces 55, 55'. The openings 56, 56' are larger than the diameter of the threaded rod 52, and are adapted to receive the rod. Abutting means are disposed on the rod 52 for abutting each of the arms 54, 54' so that the arms move and hold the pincher faces 55, 55' apart, such abutting means including at least one interiorly threaded nut 58 disposed on the rod 52 and adjustable along the length thereof. The nut 58 has an outer larger cross-sectional area than openings 56, 56' (or a dimension larger than the largest dimension of), so that it cannot pass through the openings 56, 56'. Means 60 are provided for mounting the rod 52 to one of the component parts of the assembly 10, such as the cover plate 12, so that the rod is spaced from the plate (12) to which it is mounted but is generally parallel thereto. The mounting means 60 may comprise any suitable bushing, such as a screw-threaded bushing, or an adjustable clamping band, or the like. Other structures besides the nut(s) 58 can also perform an abutting function, such as an end of the mounting means 60.

Utilization

The assembly according to the present invention may be utilized in a wide variety of ways, for performing a wide variety of functions and for accomplishing a wide variety of specialized objectives. One particular utilization is as a toolbox, and the utilization thereof will be described with respect to FIGS. 2 through 4.

In a first position of the cover plates 20, 20' relative to the plate 12, as shown in FIG. 3, the releasable holding means 40 are activated to hold the cover plates 20, 20', 120, 120' in a low volume configuration, so that the articles supported by the plates are not visible and inaccessible and so that the entire assembly 10 may be easily transported from place to place. When it is desired to gain access to the articles supported by the assembly 10, the wing nuts 43 for each of the plates 20, 20', 120, 120' are removed, and the plates 20, 20' are pivoted with respect to each other about the hinge means 26, which also results in pivoting of the spanners 14, 14' with respect to the cover plates 20, 20' and the center plate 12. The same relative motion is effected for the plates 120, 120'.

The plates 20, 20' are then moved to a second position wherein they are substantially perpendicular to the plate 12 (see FIGS. 2 and 4) and they are held together in that position, such as by permanent magnets 30. In this position, all of the articles supported by the assembly 10 are readily visible and/or accessible. To gain access to a desired article not immediately in front of the user, the plate 12 is merely rotated with respect to the casing 32 about the lazy susan 47 until the correct article supporting plate or plate portion comes into clear view. The desired articles are removed from their respective supporting means 22, utilized, and then may be replaced. Once access to the articles supported by the assembly 10 is no longer desired, the cover plates 20, 20', 120, 120' are simply moved back to their first position, and the center plate 12 lined up so that it is completely within the volume defined by the casing portions 33, 34, and then the holding means 40 are reactivated to immobilize the cover plates.

It will thus be seen that according to the present invention an article supporting assembly has been provided that may support a large number of articles in a relatively small space, having maximum space efficiency, yet is able to display all of the articles supported thereby for easy viewing and/or access. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and assemblies.

What is claimed is:

1. An article supporting assembly comprising
a center plate,
at least two spanners, each having first and second opposite edges, each of the first and second edges of each spanner parallel to but spaced from the other,
at least two cover plates,
article supporting means formed on at least one of said center plate and said cover plates, and
means for hinging each of said spanners to said center plate generally along said spanner first edges, and means for hinging said cover plates together, and means for hinging a said cover plate to each of said spanners generally along said second edge of each of said spanners, so that said cover plates are pivotal from a first position generally parallel to said center plate to a second position generally perpendicular to said center plate.

2. An assembly as recited in claim 1 further comprising means for attaching said cover plates in face-to-face relationship when they have been pivoted to said second position.

3. An assembly as recited in claim 2 wherein said attaching means comprise a permanent magnet.

4. An assembly as recited in claim 1 further comprising casing means for covering the space between said cover plates and center plate when said cover plates are in said first position.

5. An assembly as recited in claim 4 wherein said casing means comprise a housing generally quadrate in plan, and including top, bottom, and two side portions, with two open end portions generally corresponding to said cover plates and said center plate; and wherein said housing top, bottom, and two side portions have a width at least as large as the width of said spanners.

6. An assembly as recited in claim 5 further comprising releasable holding means for holding said cover plates to said casing means so that said cover plates are immobile with respect to said casing means and said center plate while said releasable holding means are activated.

7. An assembly as recited in claim 1 further comprising a support for said center plate, and handle means associated with said support for facilitating the lifting and transport of said assembly.

8. An assembly as recited in claim 1 wherein said center plate comprises first and second faces, and wherein said at least two spanners comprise four spanners, and wherein said at least two cover plates comprise four cover plates, and wherein two of said spanners and respective cover plates are operatively associated with said center plate first face, and two of said spanners and respective cover plates are operatively associated with said center plate second face.

9. An assembly as recited in claim 8 further comprising casing means for covering the space between said cover plates and said center plate when said cover plates are in said first position.

10. An assembly as recited in claim 9 wherein said casing means comprise a housing including top and bottom portions disposed above and below said center plate respectively, and disposed in planes perpendicular to the plane of said center plate, and further comprising means associated with said housing for mounting said center plate for rotational movement with respect to said top and bottom housing portions so that said center plate is pivotal from a position wherein it is within the confines of said top and bottom portions, to a position wherein it has major portions thereof without the confines of said top and bottom portions.

11. An assembly as recited in claim 10 further comprising releasable holding means for holding said cover plates to said casing means so that said cover plates and said center plate are immobile with respect to said casing means.

12. An assembly as recited in claim 9 wherein said casing means comprise a housing generally quadrate in plan, and including top, bottom, and two side portions, with two open end portions generally corresponding to said cover plates on either side of said center plate; and wherein said housing top, bottom, and two side portions have a width at least as large as the sum of the widths of the corresponding spanners on both sides of said center plate.

13. An assembly as recited in claim 9 further comprising handle means associated with said casing means, for facilitating lifting and movement of said casing means.

14. An assembly as recited in claim 1 further comprising a support for said center plate, and means for mounting said center plate to said support for rotational movement with respect to said support.

15. An assembly as recited in claim 1 wherein said article supporting means comprise means for supporting tools hanging from at least one of said center plate and said cover plates.

16. An assembly as recited in claim 1 wherein said article supporting means comprise a threaded rod, a spring clip having two arms and two pincher faces; means defining an opening in each of said arms at a portion thereof remote from said pincher faces, said opening being larger than the diameter of said rod and adapted to receive said rod; abutting means disposed on said rod for abutting each of said arms so that said arms move said pincher faces apart, said abutting means including at least one interiorly threaded nut disposed on said rod and adjustable along the length thereof, said nut having a larger cross-sectional area than said arm openings so that it cannot pass through said openings; and means for mounting said rod to one of said center plate and said cover plate so that said rod is spaced from the plate to which it is mounted, but generally parallel thereto.

17. An assembly as recited in claim 1 wherein said cover plates each have a first face parallel to said center plate in said first position, and a second face which faces said center plate, and wherein said article supporting means are disposed on said cover plates first faces, but not said second faces, and on said center plate.

18. An assembly comprising
a first plate,
first and second spanners,
first and second cover plates,
a first hinge connecting the first and second cover plates together along adjacent first edges thereof, so that the cover plates are pivotal with respect to each other,
second hinges for connecting the first cover plate to the first spanner, and the second cover plate to the second spanner, the second hinges being spaced from the adjacent first edges of the cover plates, so that the cover plates are pivotal with respect to the spanners, and third hinges for connecting the spanners to the first plate so that the spanners are pivotal with respect to the first plate.

19. An assembly as recited in claim 18 further comprising a support for said first plate, and means for mounting said first plate to said support for rotational movement with respect to said support.

* * * * *